US005156564A

United States Patent [19]

Hasegawa

[11] Patent Number: 5,156,564

[45] Date of Patent: Oct. 20, 1992

[54] TOY BUBBLE-FORMING MISSILE-LIKE DEVICE

[76] Inventor: Gary K. Hasegawa, 1457 W. Hutchinson St., Chicago, Ill. 60613

[21] Appl. No.: 712,978

[22] Filed: Jun. 10, 1991

[51] Int. Cl.[5] ..... A63H 33/28; A63H 27/00

[52] U.S. Cl. ..... 446/15; 446/16; 446/20; 446/34; 446/231

[58] Field of Search ..... 446/15, 16, 17, 18, 446/19, 20, 21, 34, 31, 32, 33, 48, 61, 230, 231

[56] References Cited

U.S. PATENT DOCUMENTS

| | | | |
|---|---|---|---|
| 2,118,748 | 5/1938 | Warham | 446/19 |
| 2,621,441 | 12/1952 | Worden | 446/34 |
| 3,002,314 | 10/1961 | Brottman | 446/15 |
| 3,600,842 | 8/1971 | Bryman | 446/15 |
| 3,913,260 | 10/1975 | Corbett | 446/16 |
| 3,950,887 | 4/1976 | Kort | 446/15 |
| 4,184,284 | 1/1980 | Rogahn | 446/15 |
| 4,379,010 | 4/1983 | Renger | 446/34 X |
| 4,923,196 | 5/1990 | Rohring | 446/33 X |
| 5,041,042 | 8/1991 | Stein | 446/15 |
| 5,078,636 | 1/1992 | Clark et al. | 446/15 |

FOREIGN PATENT DOCUMENTS

| | | | |
|---|---|---|---|
| 2040532 | 2/1972 | Fed. Rep. of Germany | 446/15 |
| 2316497 | 4/1974 | Fed. Rep. of Germany | 446/15 |
| 1509848 | 5/1978 | United Kingdom | 446/16 |

*Primary Examiner*—D. Neal Muir

*Attorney, Agent, or Firm*—John J. Kowalik; Francis C. Kowalik

[57] ABSTRACT

A bubble blower device which comprises a cyclindrical tube with a pleated periphery providing longitudinal grooves with sharp apical edges, the tube being fitted into a skirt of a cap which forms with the tube a reservoir for the bubble forming liquid which is aspirated with the tube when motivated.

5 Claims, 1 Drawing Sheet

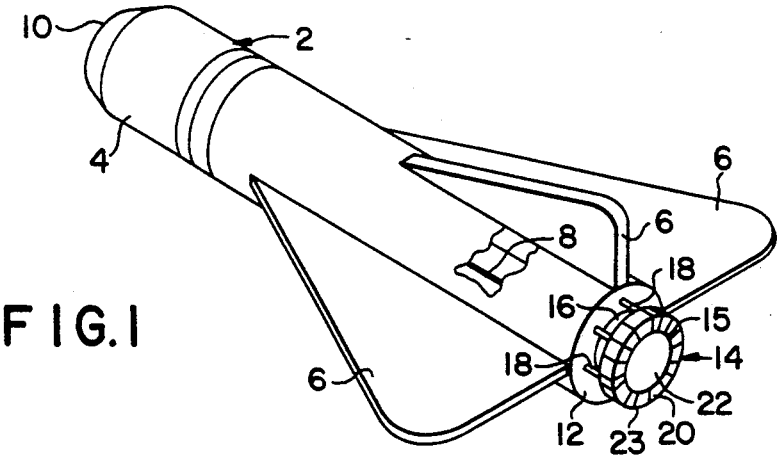
FIG.1
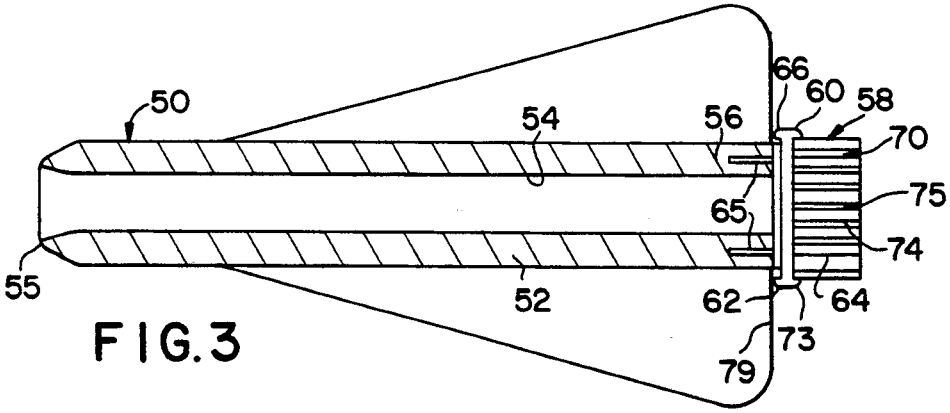
FIG.3
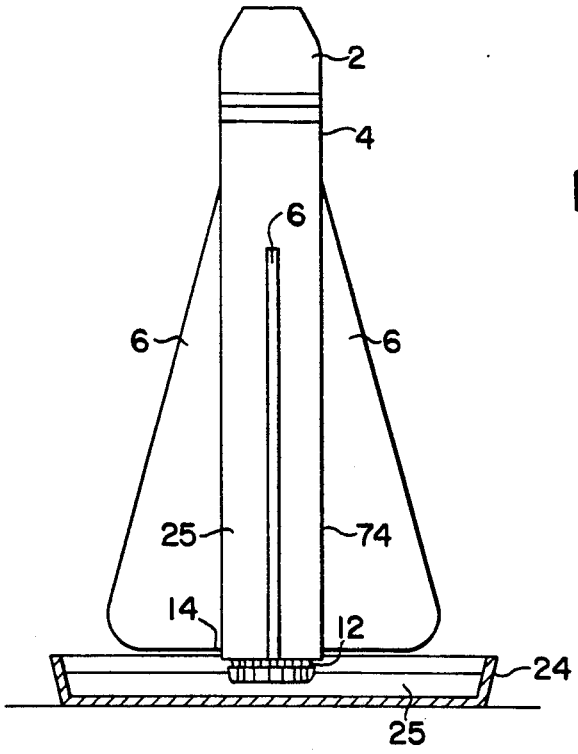
FIG.2
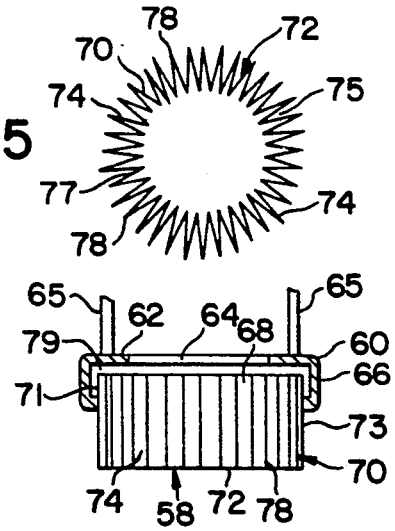
FIG.5
FIG.4

TOY BUBBLE-FORMING MISSILE-LIKE DEVICE

BACKGROUND OF THE INVENTION

1. Field of the Invention

This invention relates to a device for making bubbles. Various such devices are present and are usually of simple nature comprising a ring with a handle, the ring being designed to be dipped into a bubble forming solution which forms a membrane spanning the ring. Blowing air across the ring causes the membrane to stretch and form a bubble which upon exceeding the tensile strength of the membrane breaks loose into a free floating bubble.

2. Description of the Prior Art

U.S. Pat. No. 2,118,748 to Warham discloses a tubular bubble maker which is corrugated. It is not a pleated tube of the instant invention which provides sharp apices and V-shaped grooves to provide an interim surface which obtains the formation of a large amount of bubbles at a low pressure differential.

A bubble blowing rocket with multiple apertures is shown in Brottman U.S. Pat. No. 3,002,314. Other U.S. Pat. Nos. of interest are: 677,307; 3,246,418; 3,950,887 and 4,770,649.

SUMMARY OF THE INVENTION

A primary object of the invention is to provide a novel bubble forming device which is simple to make and which is preeminently capable of making bubbles.

A further object is to provide a device which has simple parts which may be easily assembled.

A different object is to devise a bubble maker in the form of a tube which comprises a circumferential array of pleats arranged to develop a series of V-shaped grooves extending longitudinally of the tube, the shape of the grooves enhancing the formation of bubbles.

A still further object is to provide a cap at one end of the tube forming a reservoir for the bubble forming liquid, the cap having an end wall with an aperture therein for passing blown air through the tube.

The invention comprehends a device comprising a tube formed by a circular array of pleats forming external and internal longitudinal grooves, and a cap having a skirt fitted over one end of the tube, the cap having an end wall with an aperture therein for admitting blown air through the tube, the end wall with the adjacent edge of the tube and skirt forming a reservoir for bubble liquid and the external grooves forming with the skirt air passages through which air is aspirated attendant to air being blown into the tube and thereby causing the liquid to be carried by the aspirated air into the stream of air passing through the end wall aperture into the tube.

These and other objects and advantages inherent in the device will become apparent from the specification and the drawings, wherein:

BRIEF DESCRIPTION OF THE DRAWINGS

FIG. 1 is a perspective view of the device with parts broken away;

FIG. 2 is an upstanding view of the device showing the blower being dipped into the bubble making solution;

FIGS. 3-5 show another embodiment of the invention;

FIG. 3 being as shown in part in axial section and partly in side elevation;

FIG. 4 being a side elevational view with the end cap shown in axial section, and FIG. 5 being a end view of a paper thin bubble blowing tube.

DESCRIPTION OF FIGS. 1 AND 2 OF THE INVENTION

The invention is shown incorporated in a missile 2 formed of foamed polystyrene and comprises an elongated body 4 with external guide fins 6.

The body is a tubular structure having an air passage 8 extending from end to end of the body. The passage has a flared inlet end 10 and an outlet end 12.

A bubble forming device 1 is positioned in axial alignment with the passage 8 and comprises an end cap 15 which has an end wall 16 provided with pins 18 on its forward side by which the cap is secured to the missile body by penetrating the pins onto the styrofoam. The cap has a peripheral skirt and internally is formed with V-shaped grooves 20 which extend axially of the passageway in the body. These grooves divide the interior of the skirt and guide the air exiting from the passage in the body, through an inner bore 22 defined by the edges of the ribs 23 which form the grooves.

The missile is dipped at its rear end into a pan 24 filled with a bubble forming solution 25. Thereafter the device is propelled through the air thus discharging bubbles.

DESCRIPTION OF FIGS. 3-5

In this embodiment the device is shown incorporated in a missile 50 formed of polystyrene foam. The missile 50 has a finned elongated body 52 with an axial passageway 54, the front or leading end 55 of which is flared. The rear end 56 is associated with the bubble forming device generally designated 58.

The device 58 comprises a cap 60 having an end wall 62. The wall 62 has a central aperture 64 which is aligned with the body passage. The cap is secured to the trailing end of the body by pins 65, 65 provided on the end wall which is pressed against the end of the body to cause the pins 65 to penetrate the styrofoam.

A skirt 66 is provided about the peripheral edge of the end wall and an inwardly projecting lip is provided at the aft end of the skirt is sleeved over a forward end portion 68 of a bubble forming tube 70.

The tube 70 has its cylindrical wall portion generally indicated 72 formed as a pleating. The pleats 74, 74 form grooves 75 extending longitudinally of the tube. These pleats define sharp internal and external apices 77, 78 and adjacent pleat walls are arranged in V-shape. The interior edges provide cut-offs for the stretch of bubble forming material to facilitate separation thereof from the tube as the bubble is being formed and discharged.

The end wall of the cap together with the skirt and the opposing portions of the end of the tube and pleated body of the tube, which is formed of flexible plastic such as polyethylene, provide a reservoir 79 for the bubble forming solution of the kind well known in the art.

The outer apices of the pleats oppose the skirt and therewith form inlet passages 71 for aspirating air therethrough in a forward direction due to the partial vacuum formed by the airflow through the center bore 8 as blown air is passed through the interior of the pleated cylinder. This action enhances the aspiration of the fluid solution and promotes the formation and maintenance of bubbles forming membranes or stretches menisci which bridge the internal passages in the tube. This membrane forming effect is enhanced by the narrow, 3 to 4 degree, angle subtended by the adjacent pleat walls. The narrow angle is supportive of a membrane which substantially fills the area defined by the adjacent apical pleat walls.

In order to charge the device, the tube may be removed and the rear end of the device, namely the cap portion may be immersed into the solution provided in a holding pan as shown in FIG. 2 and thereafter the tube may be inserted into the skirt. The device is now ready to be propelled as by throwing or swinging by the child.

It will be understood that the relative dimensions of the parts may be changed without avoiding the claimed aspects of the invention.

The cap may be eliminated for cost reduction and the tube 58 may be dimensioned for fit directly into the bore 54. The efficiency of such modified device would be reduced.

I claim:

1. A flying toy for making bubbles comprising an elongated body having an axial air conducting bore therein, said bore having front and rear open ends, means for forming bubbles attached to said body aft of said rear open end wherein said means for forming bubbles further comprises a reservoir, said reservoir having an end wall, said end wall defining an aperture which is coaxial with said axial bore and a cylindrical skirt located exterior to said end wall and coaxial with said aperture, said skirt extending aftward from said endwall and including an aftmost edge wherein said edge further comprises a bubble forming body locating lip, said lip extending radially inwardly from said aftmost edge and said lip, skirt and endwall are co-operative to allow passage about a bubble forming body being placed aft of said endwall and defining a void therebetween, where said bubble forming body comprises a pleated tube, said tube defining longitudinal interior and exterior grooves of narrow aspect, said grooves co-operative with said void to retain bubble forming fluid therein where said exterior grooves communicate through said void to said interior grooves so as to facilitate flow of air and bubble forming fluid forwardly through said exterior grooves through said void and into said interior grooves wherein said forward flow is induced by a partial vacuum formed by a rearward flow of air through said axial bore and past said interior grooves.

2. The invention according to claim 1 and said grooves being defined by pleat walls wherein adjacent walls meet to form apices of acute angle so as to hold bubble forming fluid as menisci between said walls and filling a space defined by said walls and apices.

3. The invention according to claim 2 wherein said menisci allow for a flow of air between said menisci and said skirt.

4. The invention according to claim 1 said tube being flexible and deflectable to provide a tight fit of an adjacent end of said tube into said locating lip of said skirt upon insertion of said tube into said skirt.

5. The invention according to claim 1 wherein said forward flow of air through said exterior grooves aspirates bubble forming fluid into said void and into said interior grooves thereby replenishing the fluid in said interior grooves and promoting the formation of bubbles upon exposure of said bubbles forming fluid contained within said interior grooves to said rearward flow of air through said axial bore and interior grooves.

* * * * *